US010900283B1

(12) United States Patent
Sheets

(10) Patent No.: US 10,900,283 B1
(45) Date of Patent: Jan. 26, 2021

(54) LADDER PLATFORM SYSTEM

(71) Applicant: Daniel J. Sheets, South Chesterfield, VA (US)

(72) Inventor: Daniel J. Sheets, South Chesterfield, VA (US)

( * ) Notice: Subject to any disclaimer, the term of this patent is extended or adjusted under 35 U.S.C. 154(b) by 91 days.

(21) Appl. No.: 16/131,652

(22) Filed: Sep. 14, 2018

(51) Int. Cl.
*E06C 1/39* (2006.01)
*E06C 7/16* (2006.01)
*E06C 7/14* (2006.01)
*E06C 7/08* (2006.01)

(52) U.S. Cl.
CPC ..... *E06C 1/39* (2013.01); *E06C 7/08* (2013.01); *E06C 7/143* (2013.01); *E06C 7/16* (2013.01)

(58) Field of Classification Search
CPC ..... E06C 7/143
See application file for complete search history.

(56) References Cited

U.S. PATENT DOCUMENTS 2,498,944 A * 2/1950 Dyer ..... E06C 7/16 182/121
3,529,251 A * 9/1970 Edwards ..... G06G 7/06 330/9
4,318,523 A * 3/1982 Weatherly ..... E06C 7/143 182/116
4,445,659 A * 5/1984 LaChance ..... E06C 7/143 182/120
4,913,394 A * 4/1990 Schmid ..... E06C 7/143 182/122
5,191,954 A * 3/1993 Ledford ..... E06C 7/143 182/121
5,727,649 A 3/1998 Buckley
5,960,905 A * 10/1999 Gardner ..... E06C 7/143 182/129
6,131,699 A * 10/2000 Leak, Jr. ..... E06C 7/14 182/129
6,241,204 B1 * 6/2001 Bermes ..... B44D 3/14 182/129
6,352,135 B1 * 3/2002 Jones ..... E06C 7/143 182/120
7,270,307 B2 9/2007 Zodnik
8,123,000 B2 * 2/2012 Whitaker ..... E06C 7/143 182/129
D753,319 S 4/2016 Constable
D785,816 S 5/2017 Constable
2004/0140409 A1 7/2004 Radda
(Continued)

FOREIGN PATENT DOCUMENTS

CA 2300151 A1 * 8/2001 ..... E06C 7/143

*Primary Examiner* — Alvin C Chin-Shue
(74) *Attorney, Agent, or Firm* — Cramer Patent & Design, PLLC; Aaron R. Cramer

(57) ABSTRACT

A ladder platform system and a ladder that uses that system include an elongated first center post that is configured to pass through a first hollow rung of a ladder. In addition, an elongated secondary post is configured to pass through a second hollow rung of the ladder. There is also a pair of short frame members and a pair of long frame members that together form a rectangular frame. The long frame members are attached to the first center post. A first platform is connected to the rectangular frame and an adjustable frame member connects the secondary post to the first center post. In addition, a brace connects a first short frame member to the adjustable frame member.

7 Claims, 4 Drawing Sheets

(56) References Cited

U.S. PATENT DOCUMENTS

| | | | | |
|---|---|---|---|---|
| 2006/0131106 | A1* | 6/2006 | Adams | E06C 7/146<br>182/129 |
| 2007/0181761 | A1 | 8/2007 | Astor | |
| 2007/0221802 | A1 | 9/2007 | New, Sr. et al. | |
| 2008/0035426 | A1* | 2/2008 | Leuthner | E06C 7/143<br>182/129 |
| 2016/0010391 | A1 | 1/2016 | Otten | |

* cited by examiner

LADDER PLATFORM SYSTEM

RELATED APPLICATIONS

Non-applicable.

FIELD OF THE INVENTION

The presently disclosed subject matter is directed to ladders and their usage. More particularly, the present invention relates to a ladder platform system for retaining items on a ladder.

BACKGROUND OF THE INVENTION

A ladder is a device that is used for accessing areas that are at a different height than the person using the ladder. A ladder can be used to climb up to a higher level, to climb down to a lower level, and to enable a user to remain at a selected level. All ladders have vertical supports and horizontal steps hereinafter called rungs. While some ladders are constructed of ropes or cables most ladders are comprised of relatively rigid side poles and relatively rigid rungs that span between the side poles.

Ladders have been used for over 10,000 years. In fact they are easily identifiable in ancient cave drawings. Over that time various limitations of ladders have been identified. In particular ladders that are used to access regions so that users can paint, build, clean, or perform other work tasks suffer from the ongoing problem of adequate working space. That is, a worker on a ladder has limited space to place paint, tools, materials, or other items that are needed to perform the ongoing work.

Various solutions to the problem of inadequate space have been developed over the years. For example, scaffolding has proven itself to be highly useful in enabling a worker or workers to perform tasks at different elevations while also providing far more space than is available on a ladder. However, scaffolding suffers not only from additional cost when compared to a ladder but also from the time and effort needed to install the scaffolding, to take it down and to move it around. In direct contrast ladders are very easy to set up, take down, and to move. In addition, ladders are low-cost devices are well-suited for use by one person.

In view of the foregoing a low cost, rapidly installed, easily removed, and simply to use ladder extension platform would be highly useful. Preferably such a platform would be safe to use and would be highly configurable. Beneficially such a platform would not impede a user climbing up and down on the ladder. Ideally such a platform could be selectively installed on a wide range of different ladders and would be suitable for moving from one ladder to another.

SUMMARY OF THE INVENTION

The principles of the present invention provide for low cost, rapidly installed, easily removed, and simply to use platforms that are suitable for attaching to ladders. Such platforms are safe to use and are highly configurable. In practice such platforms can be implemented such that they do not impede a user when that user is climbing up or down on the ladder. Beneficially such platforms can be selectively installed on a wide range of different ladders and are suitable for moving from one ladder to the next.

A ladder platform system that is in accord with the present invention includes an elongated first center post that is configured to pass through a first hollow rung of a ladder. In addition, there is an elongated secondary post that is configured to pass through a second hollow rung of the ladder. There is also a pair of short frame members and a pair of long frame members that together form a rectangular frame. The long frame members are attached to the first center post. A first platform is connected to the rectangular frame and an adjustable frame member connects the secondary post to the first center post. In addition, a brace connects a first short frame member to the adjustable frame member.

The first center post may be rectangular while the first center post may protrude from a second side of the ladder. Beneficially, the short frame members and the long frame members are comprised of "L" shaped angle stock. If so, the short frame members and the long frame members may form a barrier around the first platform. In addition, the first center post may be attached to the bottoms of the long frame members.

The adjustable frame member might include a plurality of apertures. If so the adjustable frame member can connect to the secondary post via a fastener that passes through a selected aperture of the plurality of apertures. Often the protrusion will be hollow. There also may be a second platform assembly that is removably attached to the protrusion. That second platform assembly can include a second center post and a second platform. Beneficially the second center post fits into the protrusion.

A ladder that is in accord with the present invention includes a first side, a second side, a first hollow rung, and a second hollow rung. The first and the second hollow rungs extend from the first side to the second side. In addition, there are rung apertures that pass through the first and the second hollow rungs. An elongated first center post passes through the first hollow rung and an elongated secondary post passes through the second hollow rung. In addition, there are a pair of short frame members and a pair of long frame members that form a rectangular frame. The pair of long frame members are attached to the first center post. A first platform is connected to the rectangular frame and there is an adjustable frame member that connects the secondary post to the first center post. A brace connects a first short frame member to the adjustable frame member.

The first center post may be rectangular, and the first center post may protrude from a second side of the ladder. Beneficially, the short frame members and the long frame members are comprised of "L" shaped angle stock. If so, the short frame members and the long frame members may form a barrier around the first platform. In addition, the first center post may be attached to the bottoms of the long frame members.

In practice the adjustable frame member might include a plurality of apertures. If so, the adjustable frame member may connect to the secondary post via a fastener that passes through a selected aperture of the plurality of apertures. A second platform assembly may be removably attached to the protrusion. That second platform assembly can include a second center post and a second platform. Beneficially the second center post fits into the protrusion.

BRIEF DESCRIPTION OF THE DRAWINGS

The advantages and features of the present invention will become better understood with reference to the following detailed description and claims when taken in conjunction with the accompanying drawings in which:

DESCRIPTIVE KEY

Figure 1:
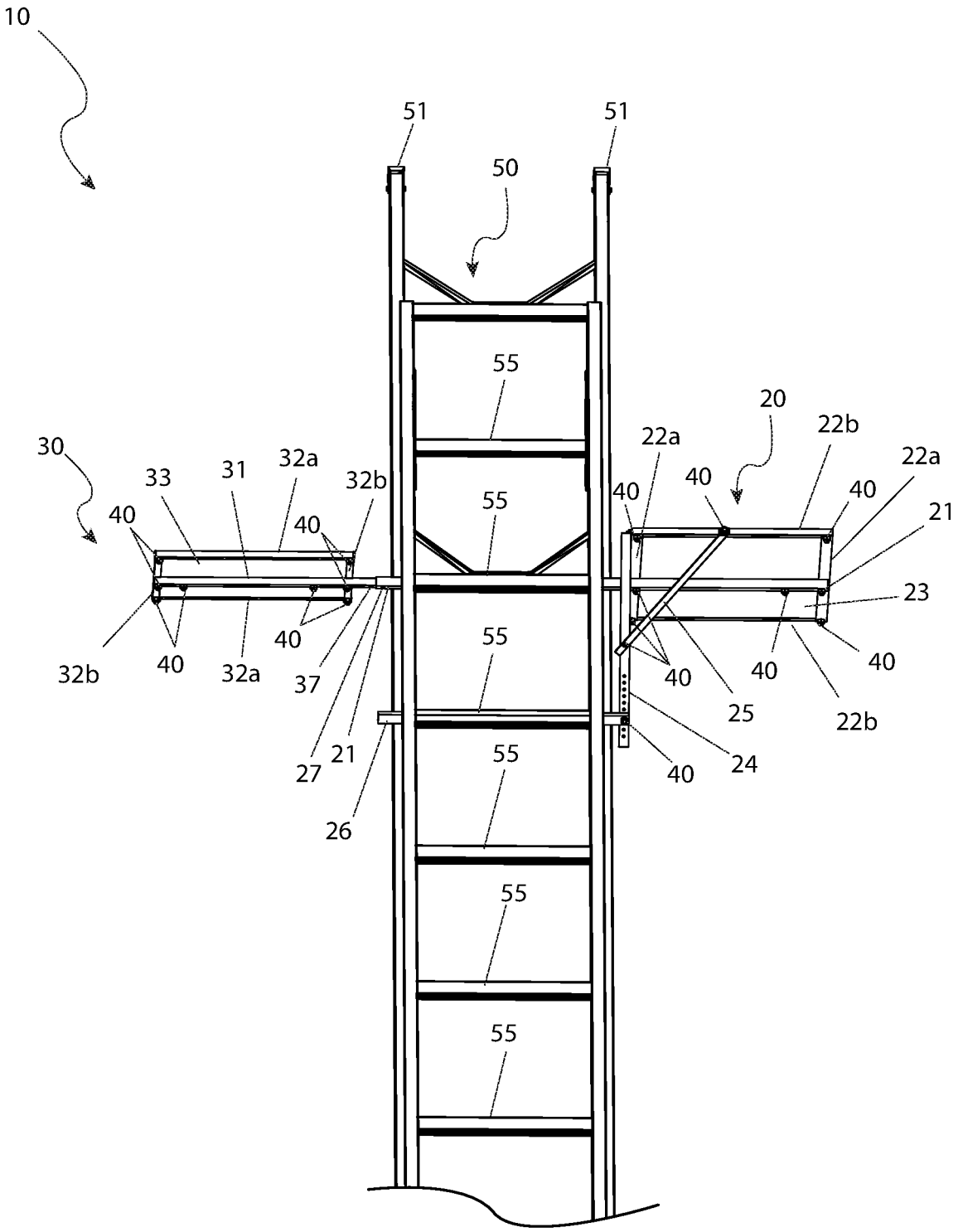
FIG. 1 is an environmental front-bottom view of a ladder platform system 10 that is in accord with a preferred embodiment of the present invention.

10 ladder platform system
20 first platform assembly
21 first center post
22*a* first platform long frame member
22*b* first platform short frame member
23 first platform
24 adjustable frame member
25 brace
26 secondary post
27 first center post aperture
30 second platform assembly
31 second center post
32*a* second platform long frame member
32*b* second platform short frame member
33 second platform
37 second center post aperture
40 fastener
47 adjustable frame member aperture
50 ladder
51 rail
52 rung opening
55 rung

DETAILED DESCRIPTION OF THE PREFERRED EMBODIMENT

The preferred embodiment of the present invention is depicted in FIGS. 1 through 6. However, the invention is not limited to the specifically described embodiment. A person skilled in the art will appreciate that many other embodiments of the invention are possible without deviating from the basic concept of the invention and that any such work around will also fall within the scope of this invention.

In the figures like numbers refer to like elements throughout. Additionally, the terms "a" and "an" as used herein do not denote a limitation of quantity but rather denote the presence of at least one of the referenced items.

Refer now to FIG. 1 for a bottom-up perspective view of a ladder platform system 10 that is in accord with the present invention. The ladder platform system 10 includes a removably installed first platform assembly 20 that is disposed along a user-selected first side of a ladder 50. The first ladder assembly 20 includes a first center post 21 that protrudes from the other side of the ladder 50 after passing through a hollow rung 55. An optional second platform assembly 30 may be removably attached to the protrusion of the first center post 21.

The first platform assembly 20 and the second platform assembly 30 are preferably lightweight, weather-resistant resilient frame members made from aluminum or plywood and are attached together with common fasteners 40 such as washers, bolts, and nuts that are also weather-resistant.

Figure 2:
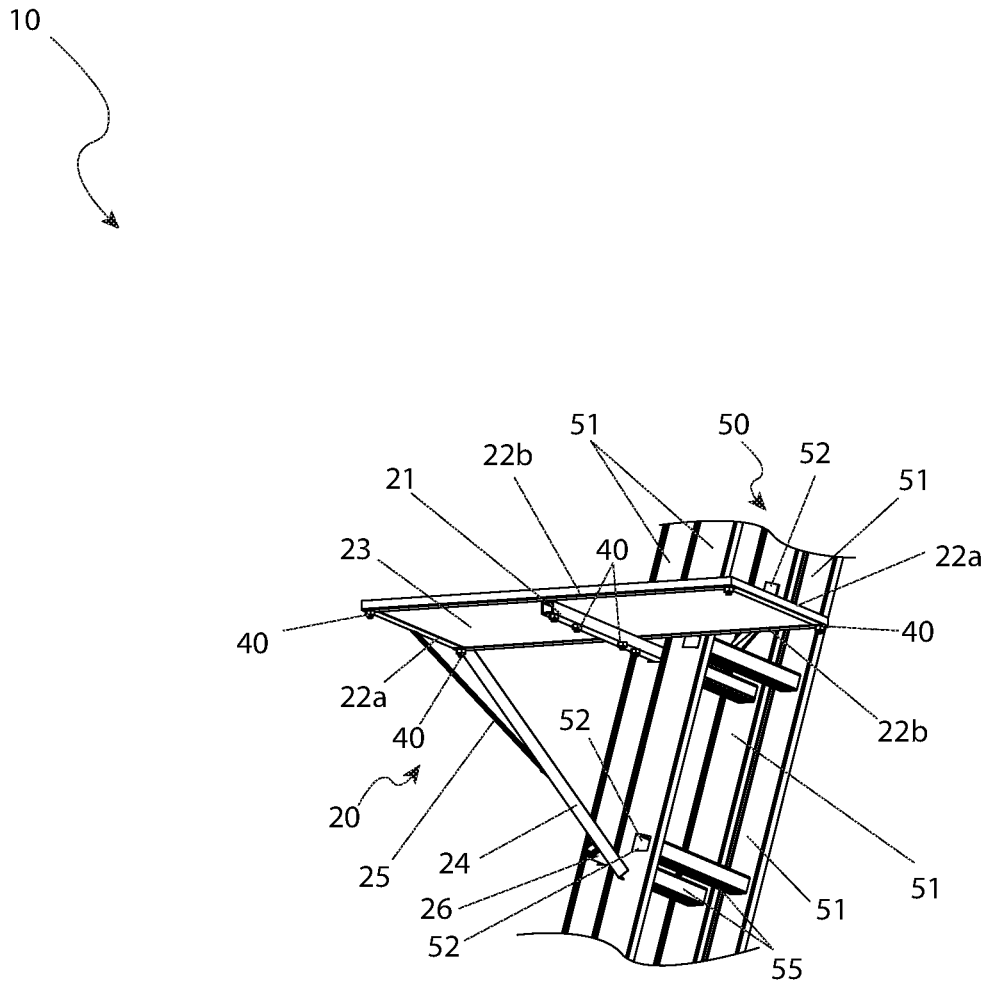
FIG. 2 is a partial environmental perspective view of a first platform assembly 20 that is used in the ladder platform system 10 of FIG. 1.

FIG. 2 illustrates the first platform assembly 20 installed on the ladder 50 through the rung 55. In addition, FIGS. 1 and 2 show a secondary post 26 of the first platform assembly 20 passing through and protruding from another rung 55 of the ladder 50 which is located below the first center post 21.

Figure 5:
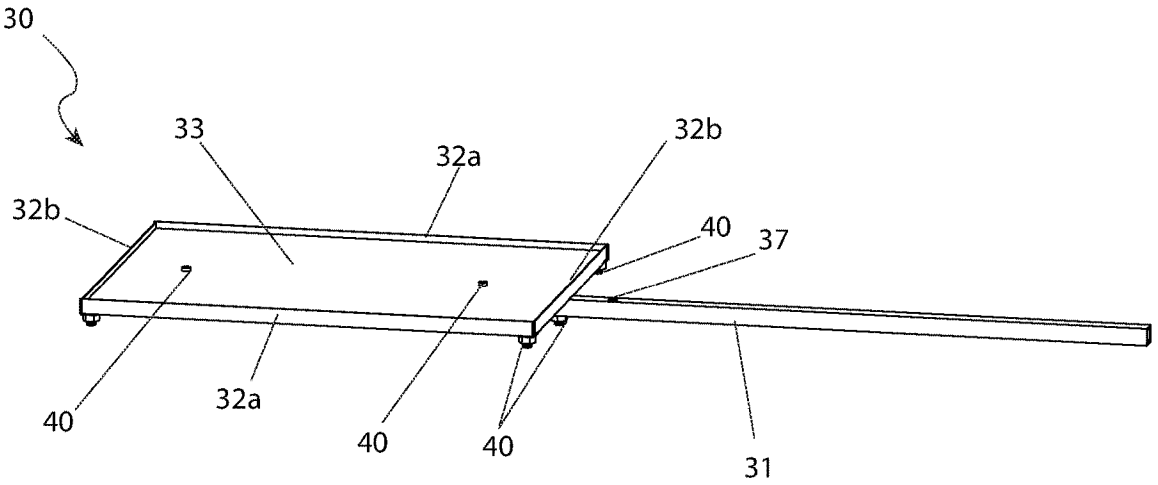
FIG. 5 is a front perspective view of a second platform assembly 30 that is used in the ladder platform system 10 of FIG. 1; and, FIG. 6 is a bottom perspective view of the second platform system 30 of FIG. 5.
Figure 6:
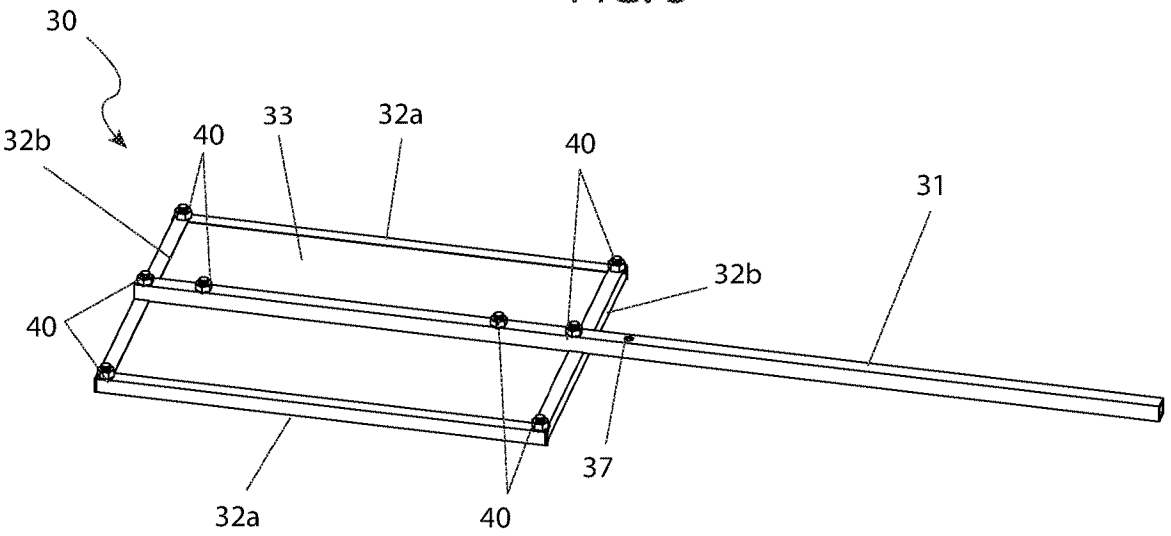

Referring now to FIGS. 1, 5, and 6, the protruding end of the first center post 21 accepts a second center post 31 of the second platform assembly 30. The secondary post 26 acts as a cantilevered support post for the first platform assembly 20. While the second platform assembly 30 is highly beneficial, particularly when heavy loads either exist or are anticipated or when a large volume of material is to be supported, it should be appreciated that the first platform assembly 20 can be used without the second platform assembly 30. Such operation is particularly beneficial when a fast set up is required and when only small, light loads are anticipated.

Figure 3:
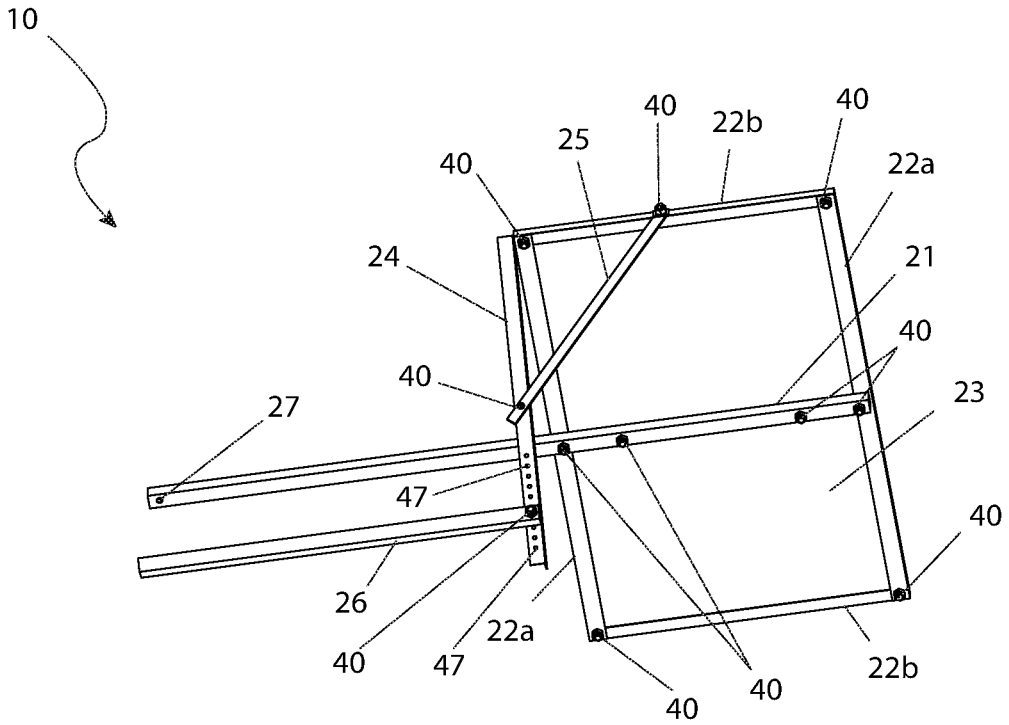
FIG. 3 is a bottom perspective view of the first platform assembly 20 of FIG. 2.
Figure 4:
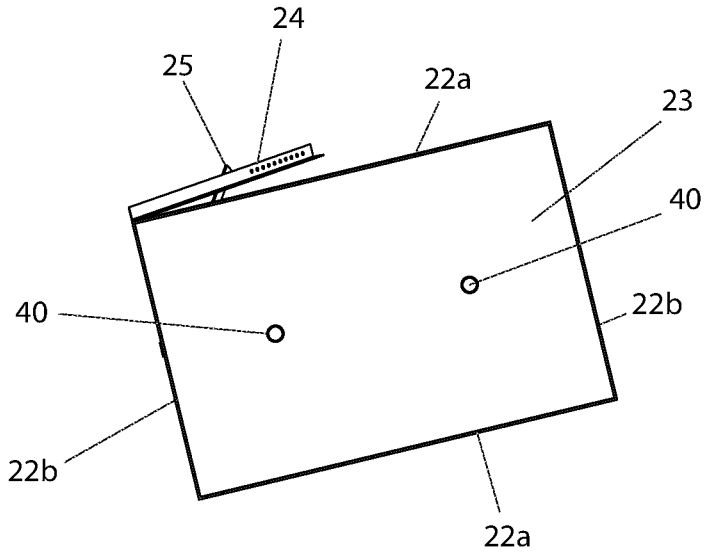
FIG. 4 is a top plan view of the first platform assembly 20 of FIGS. 2 and 3.

FIGS. 3 and 4 show some of the features of the first platform assembly 20 in more detail. The first platform assembly 20 includes a pair of first platform long frame members 22*a* and a pair of first platform short frame members 22*b* which form a rectangular frame that supports a rectangular first platform 23. The first platform long frame members 22*a* and the first platform short frame members 22*b* are preferably manufactured out of aluminum "L" or similar-shaped angle stock. In use the first platform 23 is held by the frame members 22*a*, 22*b* such that one of the "L" legs of each frame members 22*a*, 22*b* projects upward from the top of the first platform 23. The upward projecting legs then form a barrier that helps to retain items placed on the first platform 23.

Still referring to FIGS. 3 and 4, the first center post 21 is preferably a hollow element having a square cross-section with a width sufficient to enable full insertion into a rung 55. One terminal end of the first center post 21 is attached to the bottom center of a platform long frame members 22*a*. The first center post 21 beneficially bisects the first platform 23 and is attached to the bottom of the other first platform long frame member 22*a*. The first platform short frame members 22*b* extend parallel to the first center post 21.

The first center post 21 includes a first center post aperture 27 (see FIG. 3) that aligns with a second center post aperture 37 which passes through the second center post 31 of the second platform assembly 30 (see FIG. 5). The first and second center post apertures 27, 37 receive a securing fastener 40 (see FIG. 1) that attaches the second platform assembly 30 to the first platform assembly 20.

In a preferred embodiment, the first platform long frame members 22*a* are three-quarters of an inch (¾ in.) wide, one inch (1 in.) thick, and twenty-four inches (24 in.) long. Also, in that preferred embodiment the first platform short frame members 22*b* are three-quarters of an inch (¾ in.) wide, one inch (1 in.) thick, and fifteen and seven-eighths inches (15⅞ in.) long. Also, in that preferred embodiment the first center post 21 is three-quarters of an inch (¾ in.) wide, three-quarters of an inch (¾ in.) thick, and thirty-six inches (36 in.) long.

Referring once again to FIGS. 3 and 4, attached to one of the first platform short frame members 22*b* is a brace 25. The brace 25 is bent so that is can attach to an upright "L" leg of that first platform short member 22*b*. The remainder of the brace 25 is oriented at a downward angle towards the ladder 50 where it attaches to an upright "L" leg. The brace 25 is preferably a single piece of flat stock aluminum which is bent at one end. In the preferred embodiment the brace 25 is three-quarters of an inch (¾ in.) wide and fourteen inches (14 in.) long.

Located at the junction of the first platform short frame member 22*b* to which the brace 25 is attached and an adjacent first platform long frame member 22*a* is the first end of a downward extending adjustable frame member 24. Toward the bottom of the adjustable frame member 24 is a plurality of adjustable frame member apertures 47 (which preferably are equidistantly spaced). The end of the brace 25 opposite the first platform short frame member 22*b* is attached at an intermediate position to the adjustment frame member 24 using a fastener 40.

Removably attached to a selected one (1) of the plurality of adjustment frame apertures 47 is an end of a secondary post 26. The specifically selected adjustment frame aperture 47 to which the secondary post 26 is attached depends on where the desired rung 55 that is being used is located. That is explained in more detail subsequently. In the preferred embodiment the secondary post 26 is shaped the same as the first center post 21 (i.e., a hollow tubular element with a square cross-section having a width capable of full insertion within the rung openings 52 of a hollow rung 55) and is preferably three-quarters of an inch (¾ in.) wide, three-quarters of an inch (¾ in.) thick, and eighteen inches (18 in.) long.

With the first center post 21 installed through a desired rung 55 and with the secondary post 26 installed in a lower rung 55 the goal is to obtain and maintain a horizontal orientation of the first platform 23. This is to prevent items that are or will be retained thereon from falling off. The desired horizontal orientation is obtained by appropriately selecting a frame aperture 47 of the adjustable frame member 24 to be used to attach to the secondary post 26. Once the horizontal orientation of the first platform 23 is achieved a fastener 40 is passed through the secondary post 26 and the selected frame aperture 47 to lock the orientation in place. In addition, the attachment of the second platform assembly 30 onto the first platform assembly 20 renders the second platform 33 similarly oriented.

FIGS. 5 and 6 illustrate the second platform assembly 30 in more detail. The second platform assembly 30 is beneficially comprised of the same material as the first platform assembly 20. The second platform assembly 30 includes a pair of second platform long frame members 32*a* and a pair of second platform short frame members 32*b* that form a rectangular frame that supports a rectangular second platform 33.

The second platform long frame members 32*a* and the second platform short frame members 32*b* are preferably aluminum "L" are similarly shaped angle stock and are oriented with respect to the second platform 33 such that an upwardly orientated lip is formed.

The second center post 31 is a hollow square cross-sectioned element having a width that is capable of full insertion within the end of the first center post 21. One end of the second center post 31 is attached to the bottom center of a second platform short frame members 32*b*. The second center post 31 bisects the second platform 23 and is attached to the other second platform short frame member 32*b*. As discussed above, adjacent the second platform 33 is a second center post aperture 37. Also, as noted above a fastener 40 passes through the first and second center post apertures 27,37 to lock the second platform assembly 30 to the first platform assembly 20.

In a preferred embodiment, the second platform long frame members 32*a* are three-quarters of an inch (¾ in.) wide, one inch (1 in.) thick, and fifteen and seven-eighths inches (15⅞ in.) long. Also in that preferred embodiment the second platform short frame members 32*b* are three-quarters of an inch (¾ in.) wide, one inch (1 in.) thick, and eleven and seven-eighths inches (11⅞ in.) long. The second center post 31 is slightly less than three-quarters of an inch (¾ in.) wide, three-quarters of an inch (¾ in.) thick, and thirty-six inches (36 in.) long such that the second center post 31 is sized to snugly fit within the first center post 21. Alternatively, in other embodiments the second center post 31 receives the first center post 21.

The first platform 23 is envisioned to be plywood or another similar material and is sized to fit within the frame members 22*a*, 22*b*. In the preferred embodiment the first platform 23 is fifteen and three-quarters of an inch (15¾ in.) wide, one-quarter of an inch (¼ in.) thick, and twenty-three and three-quarters inches (23¾ in.) long. The second platform 33 is also envisioned to be plywood or another similar material and is sized to fit within the frame members 32*a*, 32*b*.

It should be appreciated that typical fasteners 40 can be used to attach the various elements of the ladder platform system 10, preferably such that the ladder platform system 10 can be easily broken down into its constituent parts and quickly reassembled on-site. All elements are preferably lightweight and easy to carry and can be installed. Both the first platform assembly 20 and second platform assembly 30 preferably should have the capacity to support about ten pounds (10 lbs.).

The foregoing descriptions of embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application to thereby enable others skilled in the art to best utilize the invention and various embodiments with various modifications as are suited to the particular use contemplated.

The invention claimed is:

1. A ladder platform system, comprising:

an elongated first center post passing through a first hollow rung of a ladder;

an elongated secondary post passing through a second hollow rung of said ladder;

a pair of short frame members and a pair of long frame members forming a rectangular frame, wherein said pair of long frame members are attached to said first center post;

a first platform connected to said rectangular frame;

an adjustable frame member attached to the rectangular frame at a juncture of one of said pair of long frame member and one of said pair of short frame member, and connecting said secondary post to said first center post via said on of said pair of long frame member;

a brace attached directly to a first short frame member of said pair of short frame members and connecting the first short frame member of said pair of short frame members to said adjustable frame member; and a second platform assembly that is removably attached to a protrusion disposed on said elongated first center post;

wherein said second platform assembly includes a second center post and a second platform;

wherein said second center post fits into said protrusion;

wherein said short frame members and said long frame members include "L" shaped angle stock;

wherein said short frame members and said long frame members form a barrier around said first platform;

wherein said first center post is attached to the bottoms of said long frame members; and wherein said adjustable frame member includes a plurality of apertures and wherein said adjustable frame member connects to said secondary post via a fastener that passes through a selected aperture of said apertures.

2. The ladder platform system according to claim 1, wherein said first center post is rectangular.

3. The ladder platform system according to claim 1, wherein said first center post protrudes from a second side of the ladder.

4. The ladder platform system according to claim 1, wherein said protrusion is hollow.

5. A ladder, comprising:

a ladder having a first side, a second side, a first hollow rung, and a second hollow rung, wherein said first and said second hollow rungs extend from said first side to said second side;

an elongated first center post passing through said first hollow rung;

an elongated secondary post passing through said second hollow rung;

a pair of short frame members and a pair of long frame members forming a rectangular frame, wherein said pair of long frame members are attached to said first center post;

a first platform connected to said rectangular frame;

an adjustable frame member attached to the rectangular frame at a juncture of one of said pair of long frame member and one of said pair of short frame member, and connecting said secondary post to said first center post via said on of said pair of long frame member; and a brace attached directly to a first short frame member of said pair of short frame members and connecting the first short frame member to said adjustable frame member;

a second platform assembly having a second center post and a second platform;

wherein said second center post fits into a protrusion disposed on said elongated first center post;

wherein said short frame members and said long frame members include "L" shaped angle stock;

wherein said short frame members and said long frame members form a barrier around said first platform;

wherein said first center post is attached to the bottoms of said long frame members; and wherein said adjustable frame member includes a plurality of apertures and wherein said adjustable frame member connects to said secondary post via a fastener that passes through a selected aperture of said apertures.

6. The ladder according to claim 5, wherein said first center post is rectangular.

7. The ladder according to claim 5, wherein said first center post protrudes from said second side.

* * * * *